US009909751B2

(12) United States Patent
Hwang et al.

(10) Patent No.: US 9,909,751 B2
(45) Date of Patent: Mar. 6, 2018

(54) HEAT SINK FOR LIGHTING DEVICE

(71) Applicant: ENERGYN INC., Incheon (KR)

(72) Inventors: Ihn Kee Hwang, Incheon (KR); Jin Suk Jang, Incheon (KR)

(73) Assignee: ENERGYN INC., Incheon (KR)

( * ) Notice: Subject to any disclaimer, the term of this patent is extended or adjusted under 35 U.S.C. 154(b) by 0 days.

(21) Appl. No.: 15/109,813

(22) PCT Filed: Jan. 2, 2015

(86) PCT No.: PCT/KR2015/000008
§ 371 (c)(1),
(2) Date: Jul. 6, 2016

(87) PCT Pub. No.: WO2015/102422
PCT Pub. Date: Jul. 9, 2015

(65) Prior Publication Data

US 2016/0320043 A1 Nov. 3, 2016

(30) Foreign Application Priority Data

Jan. 6, 2014 (KR) ..... 10-2014-0001039

(51) Int. Cl.
*F21V 29/00* (2015.01)
*F21V 29/51* (2015.01)
(Continued)

(52) U.S. Cl.
CPC ..... *F21V 29/51* (2015.01); *F21V 7/0066* (2013.01); *F21V 7/22* (2013.01); *F21V 15/01* (2013.01);
(Continued)

(58) Field of Classification Search
CPC ..... F21V 29/51; F21V 29/71; F21V 29/74; F21V 15/01; F21V 31/005; F21Y 2115/00; F21Y 2115/10
(Continued)

(56) References Cited

U.S. PATENT DOCUMENTS 8,888,319 B2 * 11/2014 Lee ..... F21V 29/006 313/46
2011/0044038 A1 * 2/2011 Mo ..... F21K 9/00 362/235
(Continued)

FOREIGN PATENT DOCUMENTS

KR 10-2009-0077120 A 7/2009
KR 10-2010-0127971 A 12/2010
(Continued)

OTHER PUBLICATIONS

International Search Report for PCT/KR2015/000008 dated Jan. 21, 2015 from Korean Intellectual Property Office.

*Primary Examiner* — Paultep Savusdiphol
(74) *Attorney, Agent, or Firm* — Revolution IP, PLLC

(57) ABSTRACT

Disclosed is a heat sink for a lighting device, which radiates the heat generated from the lighting device, comprising: an outer case coupled to the lighting device; an inner case accommodated into the outer case in such a manner as to be spaced apart therefrom to form a filling space between the inner case and the outer case; and a cooling medium vaporized on a portion of the outer case coupled to the lighting device by means of the heat generated from the lighting device to cool the lighting device.

8 Claims, 7 Drawing Sheets

(51) Int. Cl.

| | |
|---|---|
| ***F21V 29/77*** | (2015.01) |
| ***F21V 7/00*** | (2006.01) |
| ***F21V 7/22*** | (2018.01) |
| ***F21V 15/01*** | (2006.01) |
| ***F21V 17/10*** | (2006.01) |
| ***F21V 31/00*** | (2006.01) |
| *F21Y 115/00* | (2016.01) |
| *F21Y 115/10* | (2016.01) |

(52) U.S. Cl.
CPC ..... *F21V 17/104* (2013.01); *F21V 29/77* (2015.01); *F21V 29/773* (2015.01); *F21V 31/005* (2013.01); *F21Y 2115/00* (2016.08); *F21Y 2115/10* (2016.08)

(58) Field of Classification Search
USPC ..... 362/253, 257, 294, 373
See application file for complete search history.

(56) References Cited

U.S. PATENT DOCUMENTS

2011/0169391 A1* 7/2011 Mo ..... F21K 9/00 313/46
2012/0008329 A1* 1/2012 Wang ..... F21V 15/01 362/372
2013/0163247 A1 6/2013 Lee et al.
2013/0223064 A1* 8/2013 Lee ..... F21V 29/006 362/235

FOREIGN PATENT DOCUMENTS

KR 10-2011-0069226 A 6/2011
KR 10-2012-0024860 A 3/2012
KR 10-1142936 B1 5/2012
KR 10-2013-0116589 A 10/2013

* cited by examiner

HEAT SINK FOR LIGHTING DEVICE

CROSS REFERENCE TO PRIOR APPLICATIONS

This application is a National Stage Application of PTC International Patent Application No. PCT/KR2015/000008 filed on Jan. 2, 2015, under 35 U.S.C. § 371,which claims priority to Korean Patent Application No. 10-2014-0001039 filed on Jan. 6, 2014, which are all hereby incorporated by reference in their entirety.

TECHNICAL FIELD

The present invention relates to a heat sink for a lighting device that radiates the heat generated from the lighting device to cool the lighting device.

BACKGROUND ART

Generally, a lighting device generates light therefrom and collects the generated light thereto to emit the light in one direction.

For example, the lighting device includes a fluorescent light, an incandescent light, a halogen light, a mercury light, a sodium light, a metal light or the like.

In addition thereto, recently, an LED (Light Emitting Diode) is used as a light source of the lighting device.

The LED is an optoelectronic device which has a bonding structure of p-type and n-type semiconductors to allow electrons and holes to be bonded to each other upon application of power to emit the light of energy corresponding to the band gap of the semiconductors therefrom.

Advantageously, the LED has relatively low power consumption, semi-permanent life span, low fatigue in optic nerves, and various colors, and accordingly, the LED has been recently used for indoor and outdoor lighting.

The brightness of the LED is proportional to the strength of electric current applied to the LED.

However, if the strength of electric current is increased to raise the brightness of the LED, the strength of heat generated from the LED is also increased to cause the LED to be damaged due to the heat, thereby undesirably shortening the life span of the LED.

So as to solve the above-mentioned problems, there is proposed Korean Patent No. 10-1142936 (dated on May 10, 2012) entitled "light emitting device".

The conventional light emitting device includes a substrate having a heat pipe, an insulation film disposed on the substrate, electrode terminals located on the insulation film, and an LED package mounted on the electrode terminals, wherein the substrate having the heat pipe includes a body having at least one empty internal space, an operating fluid injected into the empty internal space, and a wick disposed on the inner peripheral wall of the empty internal space.

Under the conventional light emitting device as configured above, the LED package or a light emitting chip is mounted on the substrate having the heat pipe, and the heat generated from the LED package or the light emitting chip is radiated to the outside, thereby cooling the LED package or the light emitting chip.

However, the substrate having the heat pipe itself absorbs the heat generated from the LED package to cause the heat to be increased locally, thereby undesirably resulting in the malfunction of the LED package.

Besides, the substrate having the heat pipe has a shape of a simple container plate to cause the returning passage of the operating fluid to be extended further, so that the circulation of heat through the operating fluid is not gently achieved, thereby undesirably failing to efficiently radiate the heat.

DISCLOSURE

Technical Problem

Accordingly, the present invention has been made in view of the above-mentioned problems occurring in the prior art, and it is an object of the present invention to provide a heat sink for a lighting device that is capable of improving the heat radiation effects of the lighting device radiating high luminance light therefrom to efficiently cool an LED module.

Technical Solution

To accomplish the above-mentioned object, according to the present invention, there is provided a heat sink for a lighting device, which radiates the heat generated from the lighting device, including: an outer case coupled to the lighting device; an inner case accommodated into the outer case in such a manner as to be spaced apart therefrom to form a filling space between the inner case and the outer case; and a cooling medium vaporized on a portion of the outer case coupled to the lighting device by means of the heat generated from the lighting device to cool the lighting device.

According to the present invention, desirably, capillary protrusions are formed protrudingly from any one of the inner peripheral surface of the outer case and the outer peripheral surface of the inner case or both of the inner peripheral surface of the outer case and the outer peripheral surface of the inner case to reduce the filling space so that the cooling medium is dispersed to the filling space through the capillary phenomenon of the capillary protrusions.

According to the present invention, desirably, the outer case has heat radiation fins protruding from the outer peripheral surface thereof to enlarge the surface area thereof.

According to the present invention, desirably, one pair of heat radiation fins constitutes one set so that a plurality of heat radiation fin sets protrudes from the outer peripheral surface of the outer case, and the outer case has heat radiation plates fitted to each pair of heat radiation fins to perform the heat exchange with the outside of the outer case.

According to the present invention, desirably, a sealing cover is located between the inner case and the outer case to seal the filling space.

According to the present invention, desirably, the sealing cover is made of an insulation material to prevent the heat of the outer case from being transmitted to the inner case.

According to the present invention, desirably, the outer case has medium dispersion passages formed on the inner surface of the portion coupled to the lighting device to disperse the cooling medium of liquid phase therealong.

According to the present invention, desirably, the inner case has an accommodation space adapted to accommodate a power supplier for supplying power to the lighting device thereinto and a cap adapted to close the accommodation space.

According to the present invention, desirably, the lighting device is an LED module.

According to the present invention, desirably, the LED module includes: an LED lamp coupled to the outer case to emit the light therefrom; a reflection plate adapted to reflect the light around the LED lamp in a radiation direction of the light of the LED lamp; a guider adapted to surroundingly protect the LED lamp; a lens seated on the guider to collect the light emitted from the LED lamp thereto; and a packing adapted to seal the space between the guider and the lens.

Advantageous Effects

According to the present invention, the heat sink for the lighting device is configured wherein the medium dispersion passages serve to improve the vaporization speed of the cooling medium to prevent the heat generated from the LED module from being raised locally to the outer case, thereby improving the heat radiation effects.

Further, the heat sink for the lighting device is configured wherein the cooling medium is rapidly dispersed to the filling space by means of the capillary protrusions so that it may be dispersed uniformly to the entire portion of the filling space and further circulated gently, thereby allowing the heat generated from the LED module to be rapidly and uniformly cooled on the entire portion of the outer case.

Furthermore, the heat sink for the lighting device is configured wherein the heat radiation fins serve to increase the area contacted with the external air, thereby improving the heat radiation effects.

EXPLANATION OF REFERENCE NUMERALS IN THE DRAWING

Figure 1:
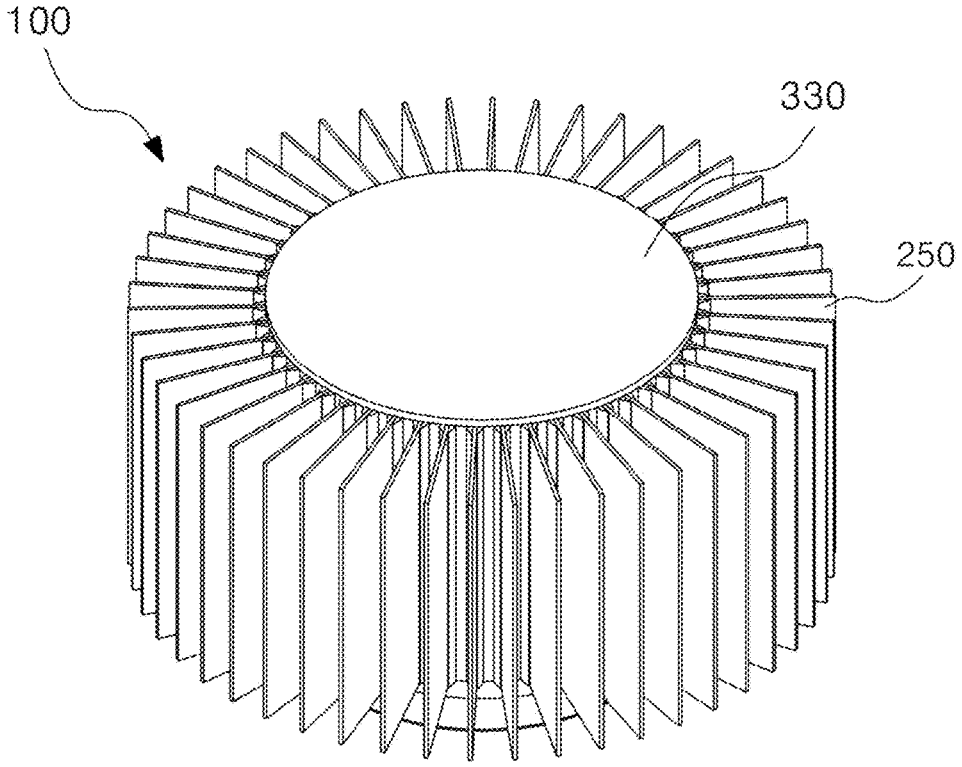
FIG. 1 is a perspective view showing a heat sink for a lighting device according to the present invention.
Figure 2:
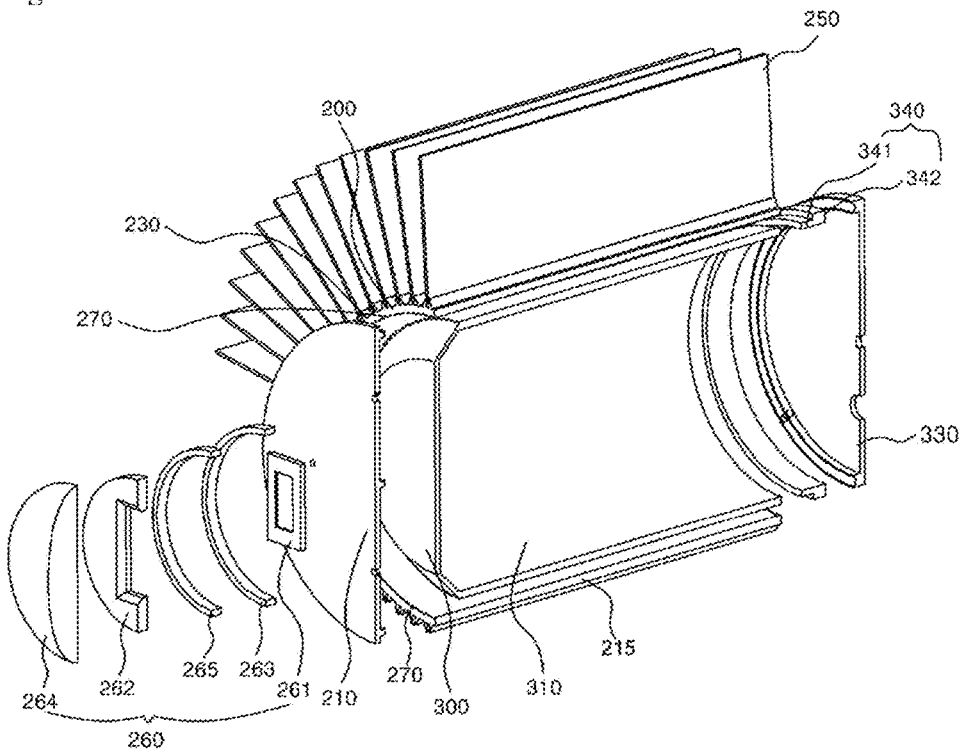
FIG. 2 is a sectional view showing the heat sink for a lighting device according to the present invention.
Figure 3:
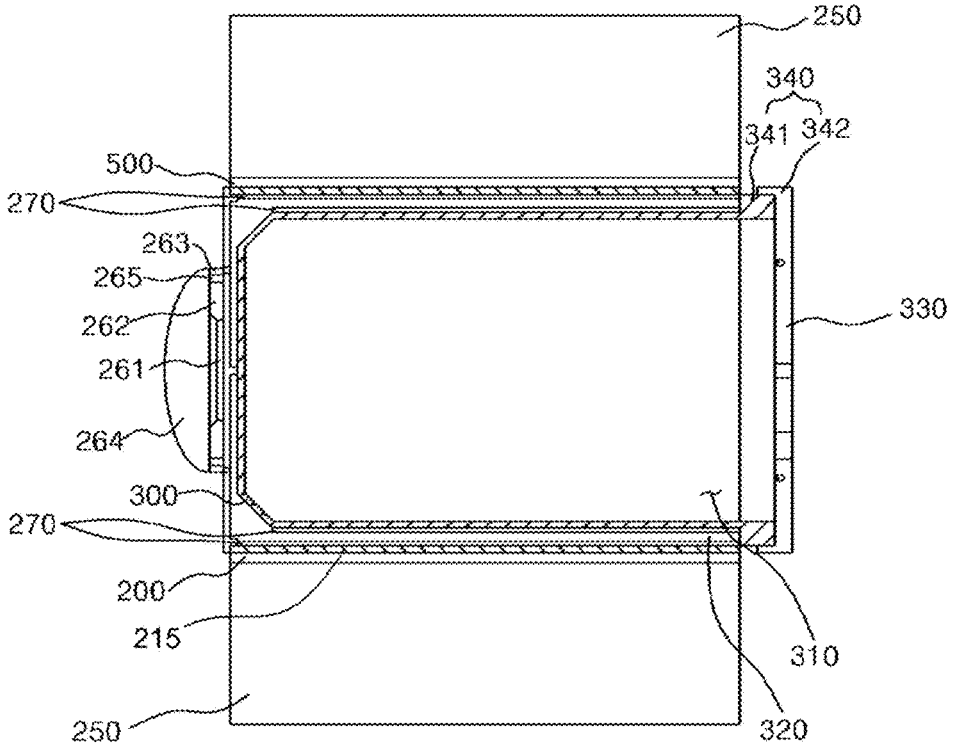
FIG. 3 is a partially cut-off perspective view showing the heat sink for a lighting device according to the present invention.

| | |
|---|---|
| 100: heat sink for lighting device | |
| 200: outer case | 210: lighting device-coupling part |
| 220: medium dispersion passage | 230: heat radiation fin |
| 240: coupling groove | 250: heat radiation plate |
| 260: LED module | 261: LED lamp |
| 262: reflection plate | 263: guider |
| 264: lens | 265: packing |
| 270: capillary protrusion | 300: inner case |
| 310: accommodation space | 320: filling space |
| 330: cap | 340: sealing cover |
| 341: coupling part | 342: locking part |
| 400: cooling medium | |

Mode for Invention

Hereinafter, an explanation on a heat sink for a lighting device according to the present invention will be given with reference to the attached drawing.

According to the present invention, first, a lighting device is adapted to generate light therefrom, collect the generated light thereto, and radiate the light therefrom. In this case, the lighting device includes all kinds of lights such as fluorescent lights, incandescent lights, halogen lights, mercury lights, sodium lights, metal lights and the like, while being not limited specifically thereto. The lighting device adopted in the present invention is an LED module 260.

As shown in FIGS. 1 to 5, a heat sink 100 for a lighting device according to the present invention includes an outer case 200.

The outer case 200 has a shape of a container empty in the interior thereof and having closed one end and includes a lighting device-coupling part 210 and a side wall part 215.

The side wall part 215 has a shape of a casing whose interior is empty and is closed on one end thereof by means of the lighting device-coupling part 210, so that the entire shape of the outer case 200 looks like a container.

On the other hand, the lighting device-coupling part 210 has a shape of a plate and is coupled to the lighting device on the outer surface thereof by means of fastening members like bolts, so that the heat generated from the lighting device is transmitted entirely to the outer case 200.

At this time, the lighting device-coupling part 210 has grooves formed correspondingly to the edges of the portion to which the lighting device is coupled, thereby allowing the lighting device to be press-fitted to the lighting device-coupling part 210.

Further, thermal grease is applied between the lighting device-coupling part 210 and the lighting device so as to enhance a degree of contact between them coupled to each other.

On the other hand, the side wall part 215 has a shape of the casing empty in the interior thereof to the form of a variety of shapes such as a rectangle, a triangle and so on.

Further, the outer case 215 is made of a metal having high thermal conductivity such as aluminum, copper, gold and their alloys so as to rapidly transmit the heat generated from the lighting device to the outer case 200.

On the other hand, the lighting device-coupling part 210 has medium dispersion passages 220.

Figure 4:
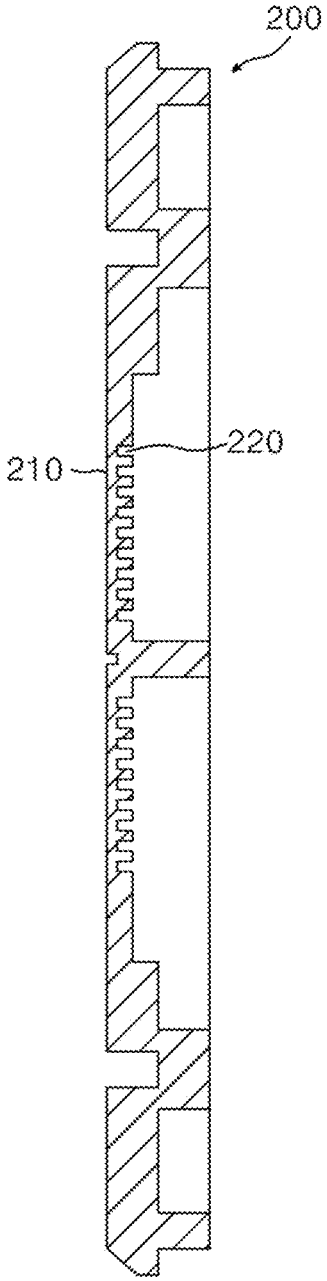
FIG. 4 is a sectional view showing a lighting device-coupling part of an outer case in the heat sink for a lighting device according to the present invention.
Figure 5:
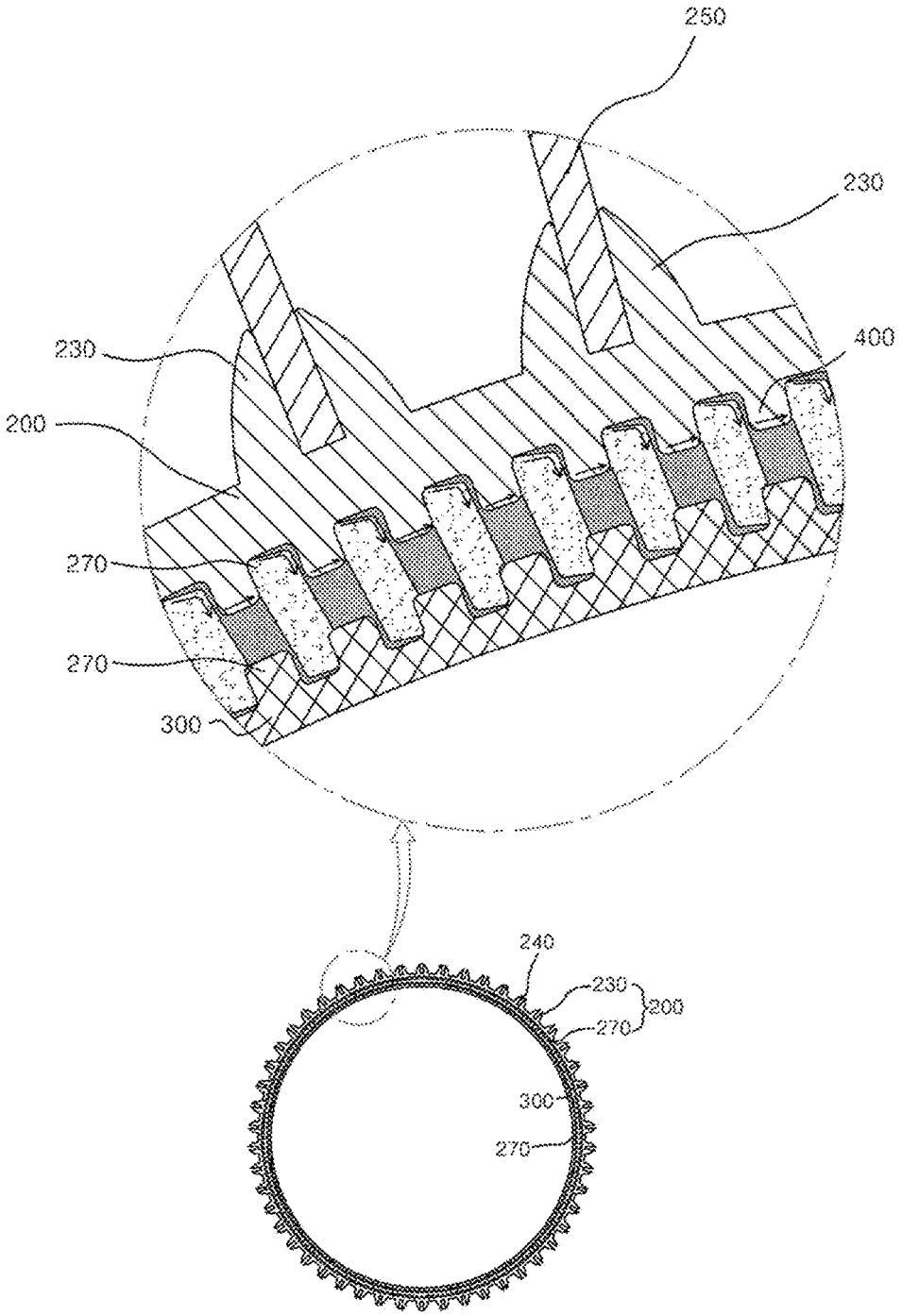
FIG. 5 is an enlarged view showing a filling space of the heat sink for a lighting device according to the present invention.

The medium dispersion passages 220 are formed on the inner surface of the lighting device-coupling part 210, that is, on the opposite surface to the surface to which the lighting device is coupled, thereby preventing the temperature of the outer case 200 from being raised locally by the heat generated from the LED module 260 (See FIG. 4).

The medium dispersion passages 220 have the shape of a plurality of grooves formed on the lighting device-coupling part 210, so that a cooling medium 400 as will be discussed later is dispersed entirely to the lighting device-coupling part 210 therealong.

On the other hand, the outer case 200 includes a plurality of heat radiation fins 230. One pair of heat radiation fins 230 constitutes one set so as to enlarge the surface area of the outer case 200. Accordingly, a plurality of heat radiation fin sets 230 protrudes radially from the outer periphery of the outer case 200.

Further, the heat radiation fins 230 are extended in a longitudinal direction of the outer case 200, and heat radiation plates 250 as will be discussed later are fitted to the heat radiation fins 230.

For example, each heat radiation plate 250 is fitted to a coupling groove 240 formed between each pair of heat radiation fins 230, so that the heat radiation plates 250 are coupled to the outer case 200.

On the other hand, the outer case 200 has the heat radiation plates 250. The heat radiation plates 250 have shapes of plates of given thickness coupled to the coupling grooves 240 so as to transfer the heat transmitted to the outer case 200 to the outside, that is, to exchange the heat transmitted to the outer case 200 with the air in the space in which the heat sink 100 is mounted.

In this case, if the lengths of the heat radiation plates 250 are extended outwardly from the outer case 200, the surface areas of the heat radiation plates 250 become enlarged, thereby improving the heat radiation effects thereof, but if so, the weights and sizes of the heat radiation plates 250 are increased to cause low portability. Desirably, the lengths of the heat radiation plates 250 are not longer than a diameter of the outer case 200.

Further, the heat radiation plates 250 are made of a metal having high thermal conductivity such as aluminum, copper, gold and their alloys so as to rapidly transmit the heat generated from the heat radiation fins 230 thereto.

The heat sink 100 for a lighting device according to the present invention includes an inner case 300.

The inner case 300 is accommodated into the outer case 200 in such a manner as to be spaced apart therefrom to form a filling space 320 between the inner case 300 and the outer case 200, and the cooling medium 400 is filled into the filling space 320.

Further, the inner case 300 has a shape of a container whose one surface is open to form an accommodation space 310 therein to accommodate a power supplier (not shown) for supplying power to the lighting device thereinto.

The heat sink 100 for a lighting device according to the present invention includes the cooling medium 400.

The cooling medium 400 is filled into the filling space 320 so as to cool the outer case 200 coupled to the lighting device. In more detail, the cooling medium 400 has a phase change from liquid to gas through the heat of the lighting device-coupling part 210 transmitted from the lighting device and thus cools the outer case 200, thereby improving the cooling efficiency of the lighting device.

That is, the cooling medium 400 of the liquid state is heated and vaporized on a portion of the outer case 200, that is, on the lighting device-coupling part 210 to which the lighting device is coupled, by means of the heat generated from the lighting device.

As the cooling medium 400 is vaporized, at this time, it radiates the surrounding heat, thereby cooling the lighting device.

Further, the vaporized cooling medium 400 is liquefied on a portion of the filling space 320 whose temperature is lowered through the heat exchange with the outside on the heat radiation plates 250 and the outer case 200. For example, if the lighting device-coupling part 210 is located on the lower side of the filling space 320, the vaporized cooling medium 400 is liquefied on an upper portion of the filling space 320 spaced from the lighting device and is circulated again to the lighting device-coupling part 210, thereby cooling the lighting device efficiently.

On the other hand, the cooling medium 400 includes a cooling medium having a relatively low temperature difference in phase change, such as water, alcohol, alkaline solution and so on.

The heat sink 100 for a lighting device according to the present invention includes capillary protrusions 270.

The capillary protrusions 270 are adapted to reduce the distance between the outer case 200 and the inner case 300 so as to allow the cooling medium 400 to be dispersed to the entire portion of the filling space 320 through capillary phenomenon.

On the other hand, the capillary protrusions 270 are formed protrudingly from the inner peripheral surface of the outer case 200 toward the inner case 300, from the outer peripheral surface of the inner case 300 toward the outer case 200, or from the corresponding positions between the inner peripheral surface of the outer case 200 and the outer peripheral surface of the inner case 300.

On the other hand, the capillary protrusions 270 are extended longer toward a direction in which the lighting device-coupling part 210 is located so as to guide the liquid phase cooling medium 400 therealong and supply it to the lighting device-coupling part 210, and otherwise, the capillary protrusions 270 protrude from the outer peripheral surface of the inner case 300, the inner peripheral surface of the outer case 200, or the outer and inner peripheral surfaces of both of the inner case 300 and the outer case 200.

As the cooling medium 400 moves to the gap reduced by means of the capillary protrusions 270 under the capillary phenomenon, it is dispersed to the entire portion of the filling space 320, thereby cooling the entire portion of the filling space 320 uniformly.

The heat sink 100 for a lighting device according to the present invention includes a sealing cover 340.

The sealing cover 340 is adapted to close the end of the outer case 200 and the end of the inner case 300 so as to allow the filling space 320 to be sealed between the outer case 200 and the inner case 300 to prevent the cooling medium 400 from being discharged to the outside or prevent the external air from being introduced into the filling space 320.

Further, the sealing cover 340 is made of an elastic material for improving the sealing force of the filling space 320, for example, rubber, urethane, silicone and the like, and has a shape of a ring.

On the other hand, the sealing cover 340 includes a coupling part 341 and a locking part 342.

The coupling part 341 has a corresponding shape to the sectional shape of the filling space 320 so as to allow the sealing cover 340 to be press-fitted to the end of the space between the inner case 300 and the outer case 200 to seal the filling space 320.

The locking part 342 is formed along the top of the coupling part 341 and has a larger periphery than the periphery of the coupling part 341 in such a manner as to be locked onto the end of the space between the inner case 300 and the outer case 200.

The heat sink 100 for a lighting device according to the present invention includes a cap 330.

The cap 330 is adapted to seal the end of the inner case 300 to close the accommodation space 310 formed in the inner case 300 and at the same time to prevent the sealing cover 340 from being escaped from the inner case 300 and the outer case 200. The cap 330 is coupled to the end periphery of the outer case 200 by means of fastening members like bolts.

The heat sink 100 for a lighting device according to the present invention includes an LED module 260. The LED module 260 is coupled to the outer case 200, that is, to the lighting device-coupling part 210 to radiate light therefrom.

On the other hand, the LED module 260 includes an LED lamp 261, a reflection plate 262, a guider 263, a lens 264, and a packing 265.

The LED lamp 261 is mounted on a substrate (not shown) electrically connected thereto to emit light therefrom, so that the LED lamp 261 mounted on the substrate is surface-contacted with the lighting device-coupling part 210.

In addition to the LED lamp 261, further, electric elements for controlling the LED lamp 261, for example, condensers, resistors, transistors and so on are mounted on the substrate.

The reflection plate 262 surrounds the edges of the LED lamp 261 in such a manner as to allow the LED lamp 261 to be located at the inside thereof and reflects the light around the LED lamp 261 in a radiation direction of the light of the LED lamp 261.

On the other hand, the reflection plate 262 is made of a metal plate having a silver color capable of reflecting the light of the LED lamp 261, and otherwise, the reflection plate 262 is formed by applying a reflection material such as paints, metal materials and so on thereto.

The guider 263 has a shape of a ring surroundingly protecting the LED lamp 261 so as to seat the lens 264 as will be discussed later on the LED lamp 261.

The lens 264 is seated on the guider 263, is fixed to the LED lamp 261, and collects the light emitted from the LED lamp 261 so as to farther emit the light of the LED lamp 261.

At this time, the lens 264 is a convex lens capable of collecting light thereto and may include different kinds of lenses laid on each other.

The packing 265 has a shape of a ring and is located between the guider 263 and the lens 264 to seal the space between the guider 263 and the lens 264.

The packing 265 is made of an elastic material such as synthetic rubber, natural rubber, synthetic resin, urethane, silicone and so on.

Now, an explanation on the operations and effects of the respective components of the heat sink 100 according to the present invention will be given.

According to the present invention, the heat radiation plates 250 are coupled to the coupling grooves 240 of the heat radiation fins 230 so as to transfer the heat transmitted to the outer case 200 to the outside.

Next, the inner case 300 is accommodated into the outer case 200 in such a manner as to be spaced apart therefrom, and the power supplier is accommodated into the accommodation space 310 of the inner case 300 so as to supply power to the LED module 260.

The plurality of heat radiation fin sets 230 are formed on the outer peripheral surface of the outer case 200, and each heat radiation plate 250 is coupled to each pair of the heat radiation fins 230.

Next, the cooling medium 400 is filled into the filling space 320.

At this time, the cooling medium 400 is filled in the state where the filling space 320 is vacuumed so that the phase change of the cooling medium 400 occurs dynamically.

The coupling part 341 of the sealing cover 340 is located at the space between the end of the outer case 200 and the end of the inner case 300 so as to seal the filling space 320 therewith.

The cap 330 is coupled to the end of the inner case 300 to completely close the accommodation space 310.

On the other hand, a portion of the LED module 260 where the heat is most generated is surface-contacted with the outer surface of the lighting device-coupling part 210, and accordingly, the LED module 260 is electrically connected to the power supplier so as to receive the power from the power supplier accommodated in the internal space of the inner case 300.

Under the above-mentioned configuration, if the power is supplied to the LED module 260 from the power supplier, the LED lamp 261 radiates light therefrom and at the same time generates heat therefrom according to the characteristics thereof.

The heat is transmitted to the lighting device-coupling part 210 of the outer case 200, and accordingly, the cooling medium 400 is heated and vaporized by means of the heat transmitted to the lighting device-coupling part 210.

At this time, the cooling medium 400 of the liquid phase is dispersed uniformly on the opposite surface to the surface to which the LED lamp 261 is coupled by means of the medium dispersion passages 220 and thus phase-changed.

The cooling medium 400 is dispersed uniformly by means of the medium dispersion passages 220 to prevent the heat generated from the LED lamp 261 from being collected to the lighting device-coupling part 210 as a portion of the outer case 200 and to rapidly transfer the vaporized cooling medium 400 to the filling space 320, thereby improving the cooling efficiency.

Since the filling space 320 is in the vacuumed state, further, the phase change of the cooling medium 400 occurs more rapidly.

Further, the heat the cooling medium 400 has had is exchanged with the heat of the outer case 200 and the inner case 300 on the portion wherein the capillary protrusions 270 are not formed on the inner peripheral surface of the outer case 200 and on the outer peripheral surface of the inner case 300, so that the cooling medium 400 of the gas state is changed to the liquid state.

Next, the cooling medium 400 phase-changed to the liquid state moves to the adjacent capillary protrusions 270 to each other by means of the capillary phenomenon, so that the cooling medium 400 is dispersed uniformly to the entire portion of the filling space 320, thereby allowing the heat generated from the LED module 260 to be uniformly dispersed and at the same time rapidly cooled.

On the other hand, the heat transferred to the outer case 200 is transmitted to the heat radiation plates 250 through the heat radiation fins 230 of the outer case 200 and thus exchanged with the external air on the heat radiation plates 250, thereby cooling the outer case 200.

So as to testify the effects of the present invention, the following tests are carried out.

Figure 6:
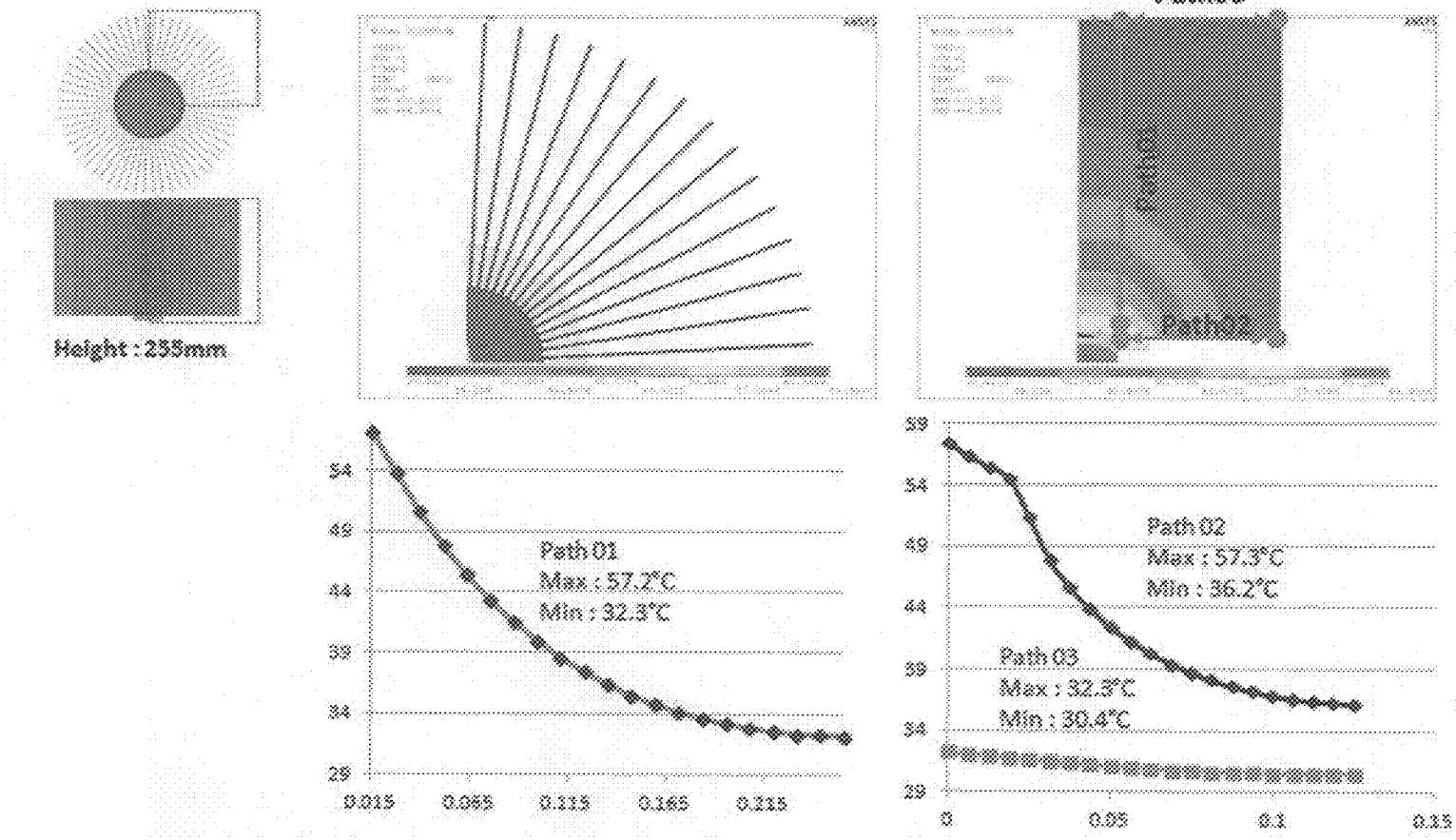
FIGS. 6 and 7 are graphs showing the comparison test results of heat distribution according to distances from an LED module so as to testify the heat radiation effects of the heat sink for a lighting device according to the present invention.
Figure 7:
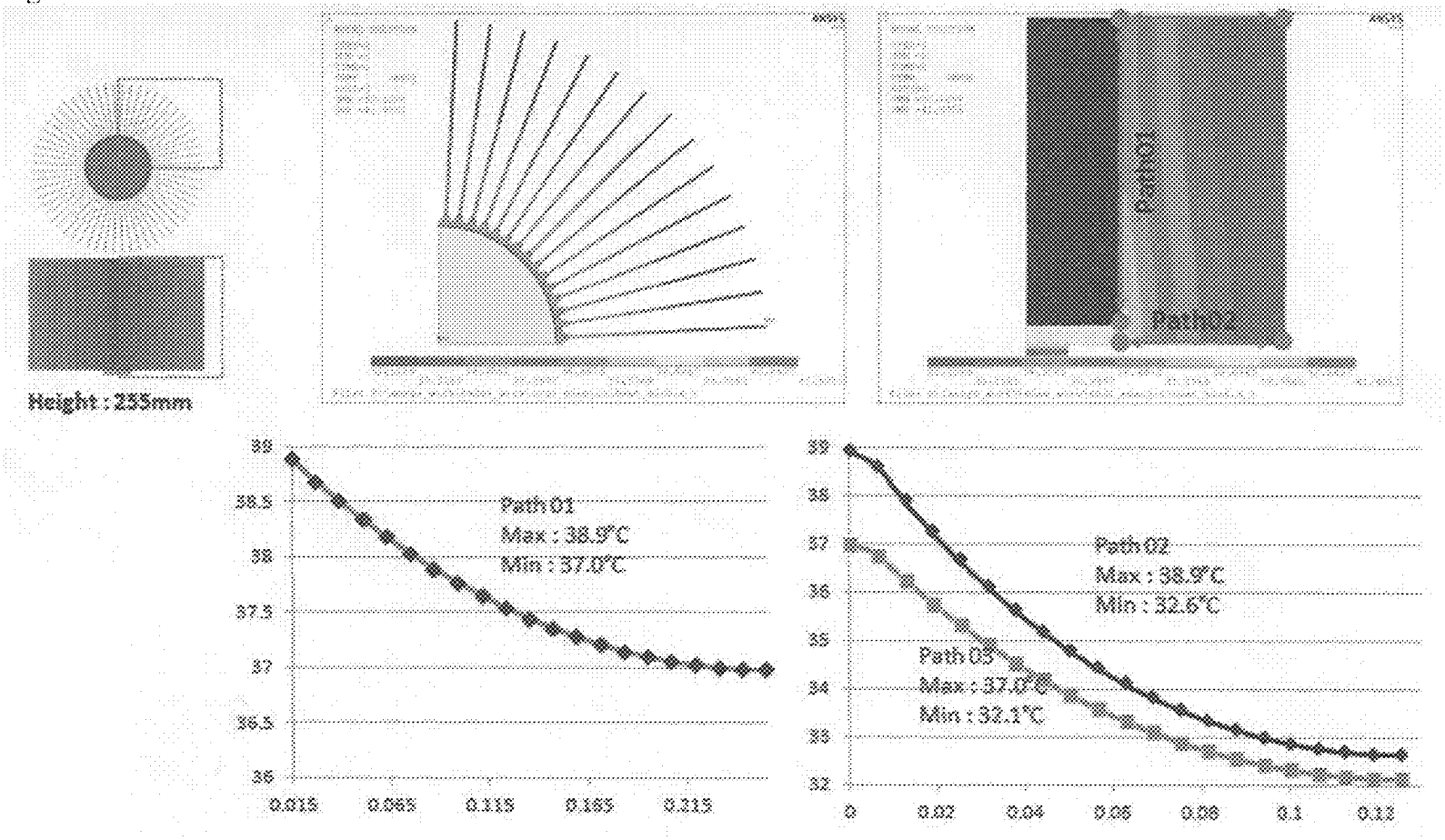

First, FIG. 6 shows a comparison example in which a heat sink has a convex-shaped body having the same size as the outer case 200 of the heat sink according to the present invention and heat radiation plates having the same sizes as those according to the present invention, and FIG. 7 shows the heat sink 100 according to the present invention.

Under the same test conditions wherein consumption power is 100 W and surrounding temperature is 25° C., the comparison test results of heat distribution according to distances from the LED module 260 are obtained to the form of graphs.

In the graphs of FIGS. 6 and 7, the x-axis indicates the distance from the LED module 260 in the unit of meter m and the y-axis indicates a temperature in the unit of Celsius ° C.

As appreciated from the graphs in FIGS. 6 and 7, the heat sink according to the comparison example shows that the heat generated from the LED module 260 is gradually lowered toward the circumferential direction of the LED module 260 from the center thereof so that the efficiency of the heat sink toward the outer periphery of the upper portion thereof becomes low, thereby undesirably reducing the heat radiation effects thereof. Contrarily, the heat sink 100 according to the present invention shows that there are only temperature differences according to the distances from the LED module 260 and the heat radiation effects are provided uniformly in upward and downward directions thereof so that the heat sink 100 according to the present invention can obtain more excellent heat radiation effects than the heat sink according to the comparison example.

FIG. 7 is a graph showing the heat distribution test results of the heat sink 100 according to the present invention, and as shown in FIG. 7, the heat generated from the LED module 260 is prevented from being raised locally on the outer case 200 and the heat radiation plates 250, thereby allowing the heat to be distributed uniformly to the outer case 200 and the heat radiation plates 250.

Accordingly, the medium dispersion passages 220 serve to improve the vaporization speed of the cooling medium 400 so that the heat generated from the LED module 260 is prevented from being raised locally on the outer case 200, thereby improving the heat radiation effects.

Further, the cooling medium 400 is rapidly dispersed to the filling space 320 by means of the capillary protrusions 270 so that it may be dispersed uniformly to the entire portion of the filling space 320 and further circulated gently, thereby allowing the heat generated from the LED module 260 to be rapidly and uniformly cooled on the entire portion of the outer case 200.

Furthermore, the heat radiation fins 230 serve to increase the area contacted with the external air, thereby improving the heat radiation effects.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

INDUSTRIAL APPLICABILITY

The present invention is useful in various industrial fields for heat radiation of all kinds of lighting fixtures and heat radiation appliances.

The invention claimed is:

1. A heat sink for a lighting device, which radiates the heat generated from the lighting device, comprising:

an outer cylindrical case being coupled to the lighting device;

an inner cylindrical case accommodated into the outer cylindrical case in such a manner as to be spaced apart therefrom to form a filling space between the inner cylindrical case and the outer cylindrical case;

a cooling medium vaporized on a portion of the outer cylindrical case coupled to the lighting device by means of the heat generated from the lighting device to cool the lighting device;

capillary protrusions formed protrudingly in a circumferential direction of one of an inner peripheral surface of the outer cylindrical case, an outer peripheral surface of the inner cylindrical case, or both of the inner peripheral surface of the outer case and the outer peripheral surface of the inner cylindrical case to reduce the filling space so that the cooling medium is dispersed to the filling space through the capillary phenomenon of the capillary protrusions; and sealing cover configured to close an entire end of the outer and inner cylindrical cases.

2. The heat sink for a lighting device according to claim 1, wherein the outer cylindrical case has heat radiation fins protruding from the outer peripheral surface thereof to enlarge the surface area thereof.

3. The heat sink for a lighting device according to claim 2, wherein one pair of heat radiation fins constitutes one set so that a plurality of heat radiation fin sets protrudes from the outer peripheral surface of the outer cylindrical case, and the outer cylindrical case has heat radiation plates fitted to each pair of heat radiation fins to perform the heat exchange with the outside of the outer cylindrical case.

4. The heat sink for a lighting device according to claim 1, wherein the sealing cover is made of an insulation material to prevent the heat of the outer cylindrical case from being transmitted to the inner cylindrical case.

5. The heat sink for a lighting device according to claim 1, wherein the outer cylindrical case has medium dispersion passages formed on the inner surface of the portion coupled to the lighting device to disperse the cooling medium of liquid phase therealong.

6. The heat sink for a lighting device according to claim 1, wherein the inner cylindrical case has an accommodation space adapted to accommodate a power supplier for supplying power to the lighting device thereinto and a cap adapted to close the accommodation space.

7. The heat sink for a lighting device according to claim 1, wherein the lighting device is an LED module.

8. The heat sink for a lighting device according to claim 7, wherein the LED module comprises:

an LED lamp coupled to the outer case to emit the light therefrom;

a reflection plate adapted to reflect the light around the LED lamp in a radiation direction of the light of the LED lamp;

a guider adapted to surroundingly protect the LED lamp;

a lens seated on the guider to collect the light emitted from the LED lamp thereto; and a packing adapted to seal the space between the guider and the lens.

* * * * *